US006153088A

United States Patent [19]

Paspek et al.

[11] Patent Number: 6,153,088

[45] Date of Patent: Nov. 28, 2000

[54] PRODUCTION OF AROMATIC OILS

[76] Inventors: Stephen C. Paspek, 459 Quail Run, Broadview Hts., Ohio 44147; Jeffrey B. Hauser, 7588 Saratoga Rd., Middleburg Hts., Ohio 44130; Christopher P. Eppig, 2193 Harcourt Dr., Cleveland Hts., Ohio 44106

[21] Appl. No.: 08/710,899

[22] Filed: Sep. 24, 1996

[51] Int. Cl.[7] ..... C10G 9/00

[52] U.S. Cl. ..... 208/131; 208/132; 208/106

[58] Field of Search ..... 208/131, 132, 208/106

[56] References Cited

U.S. PATENT DOCUMENTS

| | | | |
|---|---|---|---|
| 3,318,801 | 5/1967 | Alexander et al. | 208/40 |
| 3,324,029 | 6/1967 | King et al. | 208/97 |
| 4,178,228 | 12/1979 | Chang | 208/106 |
| 4,441,989 | 4/1984 | Spencer | 208/106 |
| 5,024,752 | 6/1991 | Yan | 208/131 |
| 5,318,697 | 6/1994 | Paspek et al. | 208/132 |

FOREIGN PATENT DOCUMENTS

| | | |
|---|---|---|
| 7235723 | 4/1974 | France . |
| 2025241 | 12/1971 | Germany . |

*Primary Examiner*—Walter D. Griffin
*Assistant Examiner*—Nadine Preisch
*Attorney, Agent, or Firm*—Robert A. Yesukevich

[57] ABSTRACT

A process for the production of aromatic hydrocarbons. The process involves heating gas oil while under pressure, and maintaining the gas oil at temperature and pressure to break the substantially aliphatic chains from the gas oil core structure of two or more aromatic rings, as well as to break the aliphatic chains to smaller molecules. The process yields products which include lighter aliphatic material, as well as aromatic hydrocarbons.

14 Claims, No Drawings

PRODUCTION OF AROMATIC OILS

BACKGROUND OF THE INVENTION

This invention relates to hydrocarbon refining and, in particular, to the production of highly aromatic hydrocarbon products.

The processing of gas oils has a long history in the petroleum refining industry. Recognizing the need to maximize useful and value added products derived from petroleum feedstocks, modern refineries chemically treat, distill, catalytically crack, thermally treat, extract, and otherwise process crude oil blends to produce a wide variety of products. Enhanced production of light ends and gasoline blending stocks yields increased volumes of heavy and residual oils that have significantly lower values than other refinery streams. Indeed, the production of many gas oils is frequently the limiting factor in overall refinery production rates.

Gas oils, as the term is used in this application; are hydrocarbon streams with an ASTM D-2887 SimDist initial boiling point (IBP) greater than 195° C., and a 5% temperature greater than 200° C. Gas oils are typically processed in one of two ways. Such oils may be thermally or catalytically "cracked" to produce lighter, i.e., lower molecular weight, hydrocarbon fractions with increased hydrogen/carbon ratios for eventual use as motor gasoline or distillate blending stocks. Alternately, gas oils are subjected to extreme heat for extended periods of time to produce solid petroleum coke and lighter hydrocarbon streams. Depending on local production constraints and product demand, one or both process may be utilized.

Applicants have discovered a third alternative process applicable to such gas oils. Recognizing that gas oils, such as FCC cycle oils, FCC gas oils, FCC decant oils, aromatic vacuum gas oils, atmospheric tower gas oils, and the like consists of a core structure of two or more aromatic rings with substantially aliphatic chains attached thereto, Applicants have discovered a novel process for breaking the aliphatic chains from the aromatic core. The process yields a mixture of substantially aliphatic lighter hydrocarbons, heavy aromatic oils, and very heavy residual oils, which can be readily separated by standard refining practices. The lighter hydrocarbons may be used as blending stocks for gasoline, distillates, or other re-refining, the heavy aromatic oils used as high value added polymer plasticizers, and the very heavy residual oils used for the production of asphalt, coke, pitch, and the like.

In typical cracking processes, the gas oil feedstock is either thermally or catalytically cracked. That is, the gas oil is broken into smaller molecules, and conditions adjusted to minimize the production of higher molecular weight materials. Catalytic cracker operation is primarily gas phase, and the time the feedstock remains in the reactor is relatively short, on the order of seconds.

Alternately, the gas oil may be coked. Unlike the cracking process described above, coking processes attempt to remove light ends from heavier materials as quickly as possible to minimize the percentage of feed that is converted to petroleum coke. In coke production, the gas oil is quickly heated to a temperature in excess of 425° C., light ends are flashed off in a coking drum, and the heavy materials maintained at an elevated temperature for a period of hours. The time at temperature causes the heavy oil to polymerize into a solid.

Unique to the current invention is the use of relatively severe conditions for relatively brief periods of time to partially crack the gas oil. The current invention severs the bonds connecting the aliphatic chains from the more rigidly structured, highly coordinated aromatic complexes in the oil. Additionally, a portion of the aliphatic chains may be cracked to form shorter, lower molecular weight hydrocarbons, while still not appreciably cracking the aromatic structure.

SUMMARY OF THE INVENTION

It is the primary objective of this invention to provide a new and improved process that yields a mixture of substantially aliphatic lighter hydrocarbons, heavy aromatic oils, and very heavy residual oils, which can be readily separated by standard refining practices. The lighter hydrocarbons may be used as blending stocks for gasoline, distillates, or other re-refining, the heavy aromatic oils used as high value added polymer plasticizers, and the very heavy residual oils used for the production of asphalt, coke, pitch, and the like.

It is a further objective of this invention to provide a process which yields a product hydrocarbon stream which may be further fractionated to produce a material with a distillation curve comparable to the original feed materials, but with a significant increase in the concentration of aromatic materials, but without increasing the Conradson Carbon of the product stream more than 10 weight percent.

Additional objective and advantages of the invention will be set forth in part of the description that follows, and in part will be obvious from the description or may be learned by the practice of the invention. The objects and advantages of the invention may be realized and attained by means of the instrumentalities and combinations particularly pointed out in the appended claims.

To achieve the forgoing object in accordance with the purpose of the invention, as embodied and broadly described herein, the process of this invention comprises heating a gas oil to a temperature in the range of about 440° C. to about 600° C. under a pressure in the range of 1.5 to 14 MPa, and maintaining said gas oil at said temperature for about one to about 120 minutes, to produce a cracked oil with a Conradson Carbon no greater than 10 percentage points higher than the feedstock, preferably with a Conradson Carbon no greater than 7 percentage points higher than the feedstock, most preferably with a Conradson Carbon no greater than 5 percentage points higher than the feedstock.

DETAILED DESCRIPTION OF THE INVENTION

While the inventive process will be described in connection with a preferred procedure, it will be understood that it is not intended to limit the invention to that procedure. On the contrary, it is intended to cover all alternative modifications, alternatives, and equivalents which may be included within the spirit and scope of the invention defined by the appended claims.

Overall, Applicants' invention relates to the selection of an appropriate feedstock, cracking the feedstock at relatively severe conditions, and separating the resulting heavy aromatic oils from lighter ends and heavy residual oil. Each aspect will be discussed individually, below.

In accordance with the invention, a suitable hydrocarbon feed stream must be selected. Appropriate feed materials should have a substantial quantity of gas oils that are highly aromatic molecular structures with aliphatic chains attached thereto. Suitable feedstocks include decant oil, distillate fractions of decant oil, FCC cycle oils, FCC gas oils, FCC decant oils, aromatic vacuum gas oils, atmospheric tower gas oils, other aromatic refinery streams, and the like. These materials are characterized by ASTM D-2887 initial boiling points (IBP) of at least about 185° C. to about 205° C., and ASTM D4530-85 Conradson Carbon values less than about 0.1% to about 10%. A particularly suitable feedstock is decant oil distillate fraction.

A typical commercial application requires the transfer of the feedstock to a cracking apparatus. Applicants have used a thermal cracking apparatus, although a catalytic cracking unit could alternately be employed. For decant oil distillate, the feedstock is supplied to the feed pump of the cracking apparatus at about 275° C. and 0.15 MPa (all pressures are absolute). The oil pressure is raised to about 5.6 MPa utilizing a pump or other means, and charged to a furnace, the thermal cracking apparatus, where the cracking takes place. Typically, the furnace is fired with natural gas or refinery gas, but any other method of maintaining operating temperatures is satisfactory. In particular, the invention, on a smaller scale can be practiced using a metal tube immersed in an electrically heated fluidized sandbath.

When using a gas fired furnace, the oil may be heated sequentially in the various zones of the furnace. For example, the oil may be preheated in the in the convection section of the furnace by the furnace flue gases, then further heated in the radiant section up to processing temperature, then maintained at operating temperatures in a soaking section of the furnace or, alternately, transferred to second furnace to maintain the oil at soaking conditions. A suitable minimum operating temperature is about 440° C., more preferably about 460° C., most preferably about 480° C. A suitable maximum operating temperature is about 600° C., more preferably about 550° C., most preferably about 520° C. The heating and soaking section of the furnace may have their own temperature control systems to maintain the oil at the appropriate operating temperatures.

The flow rate of the feed is monitored and metered to control the residence time of the feed in the thermal cracking apparatus. The operating temperature of the thermal cracking apparatus, as well as the residence time of the oil in the thermal cracking apparatus, is critical to the current invention. While not bound by theory, it is believed that higher temperatures preferentially favor thermal cracking reactions to break aliphatic side chains away from the aromatic rings in the oil molecules, as well as break the side chains into smaller aliphatic molecules instead of the competing oil polymerization reactions which form species with higher molecular weights than the feed. The cracking results in the formation of paraffin-rich light ends which have boiling points below the IBP of the feed, a middle range material rich in aromatics, and a high boiling residual oil fraction. If the cracking conditions are not severe enough, separation of the aliphatic chains will not be effected. If too severe, the oil will polymerize to a heavy residual oil or coke. Suitable minimum residence time of the oil in the cracking apparatus was about one minute, preferably about five minutes, most preferably about seven minutes. Suitable maximum residence time of the oil in the cracking apparatus was about 120 minutes, preferably about thirty minutes, most preferably about ten minutes. Suitable minimum operating pressure of the cracking apparatus was about 1.5 MPa, preferably about 1.8 MPa, most preferably about 2.0 MPa. Suitable maximum operating pressure of the cracking apparatus was about 14 MPa, preferably about 5 MPa most preferably about 4 MPa. Additionally, a selective catalyst may be used to reduce the necessary residence time, operating temperature, operating pressure, or combinations of two or more of these parameters.

The cracked oil is withdrawn from the cracking apparatus, and the pressure reduced to about 0.2 MPa by passing the oil through a venturi, an orifice, a letdown valve, and the like, that also may be used to maintain the pressure in the cracking apparatus within the ranges described above. The heavy aromatic oil is then separated from the remainder of processed oil by any of a number of methods known in the art. These include, but are not limited to distillation, extraction, selective reaction, stripping, crystallization, and the like. Typically, distillation is used.

A representative distillation process uses a flash, packed or trayed distillation tower, and combinations or multiples of these processes. Depending upon yield of the thermal treatment, a simple overhead or bottoms cut may be appropriate. Typically, the process oil is charged to a distillation tower or the like, and two or more products are withdrawn. Specifically, an overhead product of light ends may be produced, a bottoms cut of high boiling residual oil, and one or more side draws of aromatic rich gas oil. The sidedraw (or sidedraws) may be steam stripped to remove any remaining light boiling components.

The overhead product, rich in saturated hydrocarbon and paraffinic oil, may be separated in a three-phase decanter to remove non-condensable gas which may be flared or burned for fuel value, and water resulting from the steam stripping. Optionally, high boiling residual oil is withdrawn from the bottom of one of the distillation columns. Optionally, the residual oil may be steam stripped to remove any lighter hydrocarbon fractions. The resulting residual oil has a high viscosity at low temperatures. To improve handling, the residual oil may be diluted with lighter material, such as unprocessed decant oil, or a second sidedraw product from the distillation column, heavier than the aromatic rich gas oil cut, to improve flow characteristics and to ease removal from the tower using a bottoms pump. Additionally, a second sidedraw stream, lighter than the aromatic rich gas oil fraction may be recycled to the feed of the process, to permit recycle operation to improve aromatic oil yields, and to reduce yields of the residual oil bottoms stream.

EXAMPLE

A light end fraction of FCC decant oil was selected as a feedstock. The feedstock had the properties listed in Table I. The feedstock was charged to feed tank connected via a bottom port to a McFarland double piston pump, whose discharge was connected to two 20 foot long (6.1 m) coils of ¼" (6.35 mm) outside diameter×0.19" (4.72 mm) inside diameter 316 stainless steel tubing connected in series and immersed in two Techne IFB 51 fluidized sand baths maintained at isothermal conditions at 400° C. to preheat the feedstock. The outlet of the second preheat coil was connected to a 28 foot long (8.53 m) coil of ⅜" (6.35 mm) outside diameter by 4.57 mm inside diameter (0.049" wall) 316 stainless steel reactor tube immersed in a third Techne IFB 51 fluidized sand bath maintained at isothermal conditions at 500° C. The pump was adjusted to deliver feedstock to the reactor tube at a rate of 79 ml/min, to provide approximately 7 minutes residence time of the feedstock in the reactor tube, based on the cold oil reactor volume.

After flowing through the reactor tube at soaking the temperature of 500° C., the resulting material was cooled to near room temperature with a water cooled heat exchanger, and collected in a high pressure receiver fitted with a back pressure regulator which maintained a system pressure of 3.55 MPa. The receiver was isolated and the overhead vented to reduce the receiver pressure to ambient. Liquid product was withdrawn from the receiver using a bottom collect port.

The resulting thermally treated liquid fraction was analyzed, and had the propertied listed in Table I. A 3.5 gallon sample of the thermally treated liquid fraction was transferred to an 22 l ASTM D-2892 distillation apparatus to remove light ends up to an atmospheric equivalent cut point of 640° F. (338° C.). The remaining liquid material was transferred to a D-5236 pot still and further distilled to a atmospheric equivalent cut point of 760° F. (404° C.). The resulting distilled liquid was analyzed, and the results are also recorded in Table I.

TABLE I

| | FEEDSTOCK | THERMALLY TREATED | DISTILLED |
|---|---|---|---|
| ASTM D-2887(° C.) | | | |
| IBP | 304 | 14 | 297 |
| 5% | 327 | 166 | 323 |
| 50% | 359 | 355 | 357 |
| 95% | 394 | 474 | 385 |
| FBP | 409 | 615 | 410 |
| Mean boiling point (° C.) | 357 | 347 | 357 |
| Ave. MW (g/mol) | 247 | 234 | 226 |
| UOP "K" factor | 10.2 | 10.1 | 9.7 |
| API Gravity | 6.5 | 5.97 | 0.46 |
| Aniline point (° C.) | 24 | — | — |
| Saturates (wt %) | 20.0 | — | <10 |
| Refractive Index @ 21° C. | 1.6042 | — | 1.6447 |
| Flash Point (Cleveland Open Cup) (° C.) | 199 | — | — |
| Carbon NMR (%) | | | |
| Aromatic Carbon | 63.3 | — | 74.5 |
| Saturated Carbon | 35.9 | — | 25.5 |
| n-Paraffins | 7.9 | — | 5.6 |
| Conradson Carbon ASTM D-4530-85 (wt %) | <0.1 | 4.4 | <0.1 |

—indicates data not available

What is claimed is:

1. A process for the production of aromatic oils, comprising heating a gas oil with an aromatic carbon content, as measured by carbon NMR, greater than about 60 percent, to a temperature in the range of about 440° C. to about 600° C. under a pressure in the range of 1.5 to 14 MPa, and maintaining said gas oil at said temperature for a residence time of about one minute to about 120 minutes, to produce a cracked oil with a Conradson Carbon no greater than 10 weight percentage points higher than said gas oil.

2. The process of claim 1 wherein said gas oil is selected from the group consisting of FCC cycle oils, FCC gas oils, FCC decant oils, aromatic vacuum gas oils, atmospheric tower gas oils, and fractions and combinations thereof.

3. The process of claim 1 wherein said gas oil is selected from the group consisting of FCC decant oils and distillate fractions of FCC decant oils.

4. The process of claim 1 wherein said gas oil is an FCC decant oil distillate fraction with a final boiling point of about 410° C.

5. The process of claim 1, wherein said temperature is in the range of about 460° C. to about 550° C.

6. The process of claim 1, wherein said temperature is in the range of about 480° C. to about 520° C.

7. The process of claim 1, wherein said residence time is in the range of about five minutes to about thirty minutes.

8. The process of claim 1, wherein said residence time is in the range of about seven minutes to about ten minutes.

9. The process of claim 1, wherein said pressure is in the range of about 1.8 MPa to about 5 MPa.

10. The process of claim 1, wherein said pressure is in the range of about 2 MPa to about 4 MPa.

11. The process of claim 1, further comprising fractionating said cracked oil.

12. The process of claim 11, wherein said fractionating comprises a method selected from the group consisting of distilling, extracting, selective reacting, stripping, crystallizing, and combinations of the same.

13. The process of claim 12, wherein said method is distillation.

14. The process of claim 13 wherein said distillation utilizes a tower selected from the group consisting of flash distillation towers, packed distillation towers, trayed distillation tower, and combinations thereof.

* * * * *